United States Patent [19]

Dobrosielski et al.

[11] 4,083,027

[45] Apr. 4, 1978

[54] PUSHBUTTON ELECTRIC SWITCH

[75] Inventors: Stephen S. Dobrosielski, Beaver; Edward L. Richards, Aliquippa; Paul Skalka, Beaver, all of Pa.

[73] Assignee: Westinghouse Electric Corporation, Pittsburgh, Pa.

[21] Appl. No.: 757,547

[22] Filed: Jan. 6, 1977

Related U.S. Application Data

[63] Continuation of Ser. No. 634,729, Nov. 24, 1975, abandoned, which is a continuation of Ser. No. 573,370, Oct. 9, 1974, abandoned.

[51] Int. Cl.[2] ..... H01H 71/16

[52] U.S. Cl. ..... 337/66; 337/72

[58] Field of Search ..... 337/72, 66, 70; 335/17, 335/26, 27; 200/159

[56] References Cited

U.S. PATENT DOCUMENTS

| | | | |
|---|---|---|---|
| 2,374,778 | 5/1945 | Platz | 337/72 |
| 2,473,901 | 6/1949 | Pierce | 337/66 |

*Primary Examiner*—Harold Broome
*Attorney, Agent, or Firm*—L. P. Johns

[57] ABSTRACT

A circuit interrupter characterized by a manually operated fast acting switch and an overload relay for tripping of switch in response to current overload. The switch comprises means for moving electric contacts between open and closed and tripped positions which means includes a releasable arm which is movable between latched and unlatched positions. The switch also comprises a pair of pushbuttons for manually opening and closing the switch which pushbuttons are effective to move a lever which in turn actuates an overcenter toggle mechanism for opening and closing the switch.

7 Claims, 4 Drawing Figures

PUSHBUTTON ELECTRIC SWITCH

CROSS REFERENCE TO RELATED APPLICATIONS

This is a continuation of application Ser. No. 634,729, filed Nov. 24, 1975, which is a continuation of application Ser. No. 573,370, filed Oct. 9, 1974, both abandoned. This invention is related to the inventions disclosed in the following applications, Ser. No. 345,396, filed Mar. 27, 1973, now U.S. Pat. No. 3,810,051, issued May 7, 1974; Ser. No. 513,372, filed Oct. 9, 1974, now U.S. Pat. No. 3,930,214, issued Dec. 30, 1975; and Ser. No. 513,371, filed Oct. 9, 1974, now U.S. Pat. No. 3,930,213, issued Dec. 30, 1975.

BACKGROUND OF THE INVENTION

1. Field of the Invention

This invention relates to a circuit interrupter having switch tripping mechanisms responsive to current overloads and pushbutton manually operative means.

2. Description of the Prior Art

Some circuit interrupters of prior construction have been provided with current overload protective devices that function satisfactorily in response to abnormal current such as overcurrents, ground fault currents, and short circuits, that occur in an electrical distribution system. A circuit breaker of that type is disclosed for example in U.S. Pat. No. 3,530,314. Some circuit breakers of that type are provided with toggle handles by which manual operation is accomplished. A disadvantage of the toggle handle is that it may be accidently operated. Moreover, for some purposes there is a preference for a pushbutton type of manual operation rather than the toggle handle.

SUMMARY OF THE INVENTION

In accordance with this invention it has been found that the foregoing problem may be overcome by providing a circuit interrupting device which comprises a switch mechanism and an electrically insulating housing therefor, the switch mechanism comprising relatively movable contact means and operating means for moving the contact between open and closed positions, the operating means comprising an overcenter toggle and releasable arm movable to effect movement of the movable contact structure, lever means operatively connected to the releasable arm for moving the operating means between closed and open positions, said housing having an opening, and a pair of pushbuttons extending through the opening which are separately operable to move the lever means between open and closed positions respectively.

Associated with the foregoing, means may be added to releasably effect automatic opening of the contact means in response to an overload condition which may occur in the line.

The advantage of the device of this invention is that a manually operated toggle mechanism which provides switching control to alternately close and open electrical contacts is combined with a pushbutton type of manual operation which avoids the problems of accidental operating of the conventional toggle handle; and where the device is combined with an overload relay to provide for automatic tripping of the manually operated pushbuttons.

DESCRIPTION OF THE PREFERRED EMBODIMENTS

Figure 1:
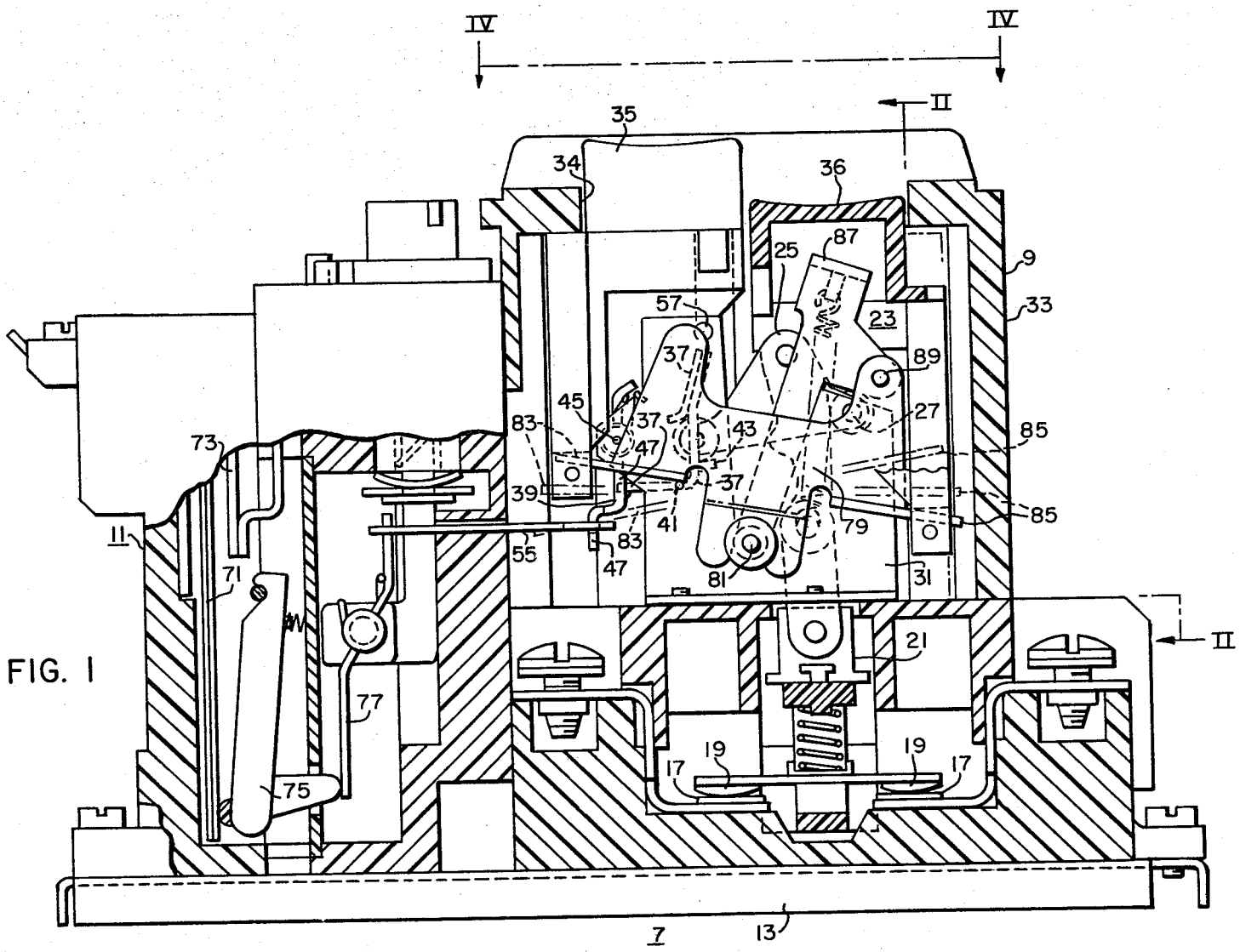
FIG. 1 is a vertical sectional view through a three pole overload relay and a circuit interrupter, the latter of which is provided with pushbuttons in accordance with this invention.
Figure 4:
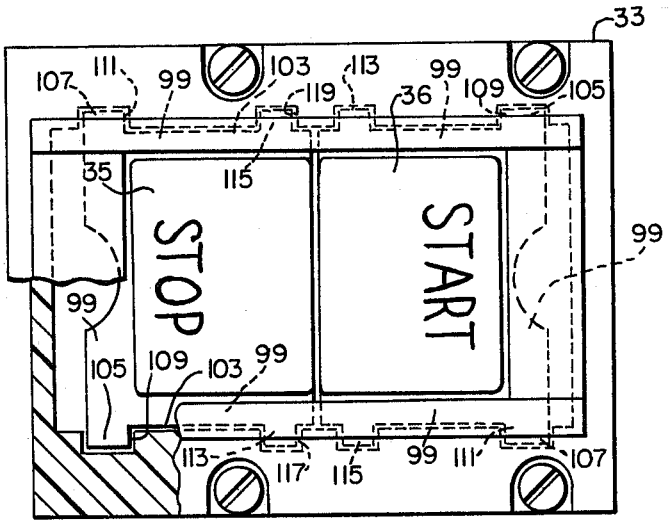
FIG. 4 is a plan view taken on the line IV—IV of FIG. 1.

In FIG. 1 a circuit interrupter is generally indicated at 7 and it comprises a manually operated switch 9 and an overload relay 11, both of which are mounted on a supporting base 13.

Figure 2:
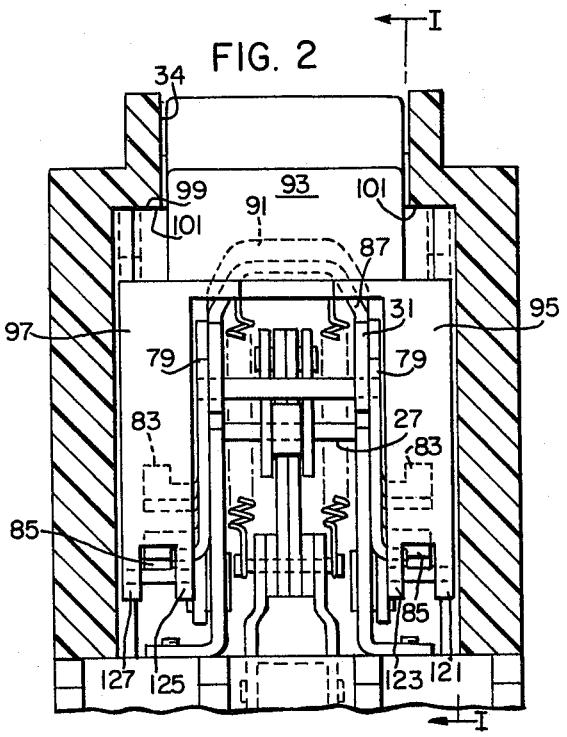
FIG. 2 is a vertical sectional view taken on the line II—II of FIG. 1.

Inasmuch as a detailed description of the switch 9 is set forth in the application of Edward L. Richards, Ser. No. 404,579, filed Oct. 9, 1973, the description here is limited to the part that are essential to the operation of the invention disclosed herein. Suffice it to say, the switch 9 is a multi-pole, such as a three-pole, switch which includes a pair of stationary contacts 17, a pair of movable contacts 19, as well as movable contact carrier means 21. The switch 9 also comprises a manually operated overcenter toggle mechanism generally indicated at 23 which in turn comprises a releasable arm 25 that is pivotally mounted on a pivot pin 27 that extends between a pair of upright frames 29 and 31 (FIG. 2). The overload toggle mechanism 23 is enclosed within a housing 33 of electrically insulating material and includes a pair of manually operated pushbuttons 35 and 36 which extend upwardly through an opening 34 on the top surface of the housing.

The right end of the releasable arm 25 is retained in a latched position in a manner disclosed in the application of Edward L. Richards, Ser. No. 513,371 filed Oct. 9, 1974 for which reason the description herein is limited to the parts that are essential to the operating of the invention disclosed herein. Suffice it to say, the trip mechanism comprises a latch lever 37 and a retainer lever 39. The latch lever 37 is an L-shaped or bell crank type lever which is pivoted on a pair of similar trunnions 41 extending from opposite sides thereof into corresponding apertures in the spaced upright frames 29, 31. The latch lever 37 also includes an opening 43 in which the left end of the arm 25 is seated when in the latched position as shown in FIG. 1. The lower end of the latch lever 37 extends to and is engaged by the retainer lever 39 which is a substantially vertically extending member having similar trunnions 45 extending from opposite sides thereof and seated in corresponding apertures in the spaced upright frame 29, 31. A hole 47 is disposed in the retainer lever 39 below the trunnion 45 and the lower end of the latch lever 37 is seated in the hole when in the latched condition. The lower end portion of the retainer lever 39 is disposed in an aperture 53 of a trip plate 55, which as shown in FIG. 1, extends from the overload relay 11. When the trip plate 55 is moved by the relay to the left, as viewed in FIG. 1, the retainer lever 39 rotates clockwise until the lower extremity of the latch lever 37 moves out of the hole 47, whereupon the latch lever rotates counterclockwise. The releasable arm 25 rotates clockwise until it strikes a stop pin 57 which extends between the upright frame 29, 31. Movement of the retainer lever 39 and the latch lever 37 in the manner described constitutes "tripping" of the circuit interrupter 7 and causes the movable contact 19 to separate from the stationary contacts 17.

Inasmuch as the overload relay is disclosed specifically in the application of E. L. Richards, Ser. No. 471,740, filed May 20, 1974, the description of the relay is limited to the parts which are essential to operation of the invention disclosed herein. The relay includes bimetals 71, bimetal heaters 73, a crossbar 75, a pivoted trip lever 77, and the trip plate 55. When a current in excess of that for which the heater elements are rated to handle occurs, the heaters 73 causes the bimetal to move the crossbar 75 against the lower end of the trip lever 77 causing the upper end thereof to rotate counterclockwise and pull the trip plate 55 to the left, whereupon retainer lever 39 is rotated clockwise as set forth above. In that manner the switch 9 is tripped automatically when the current overload occurs in the current supply.

In accordance with this invention, the switch 9 is provided with the pushbuttons 35, 36 as well as two rocker arms or operating levers 79 by which the overcenter toggle 23 is actuated to open and close the contacts 17, 19. The operating levers 79 (FIG. 1) are provided in pairs which as shown in FIG. 2 are separately mounted on the outer surface of the upright frames 29 and 31. Both levers 79 are similar in construction, and as shown in FIG. 1 the lever 79 is pivotally mounted at 81 and provided with a pair of outturned flanges or projections 83, 85 which are disposed in planes perpendicular to the plane of the flanges 79. The levers 83 are disposed at the lower end of and is actuated by the pushbutton 35, and the flanges 83 are disposed at the lower end of and are actuated by the pushbutton 36. In addition, the operating levers 79 are secured to similar switch levers 87 by similar pins 89, which lever 87 are pivotally mounted at the pivot point 81. As shown more particularly in FIG. 2 the levers 87 are integral parts by virtue of an intermediate member 89.

Figure 3:
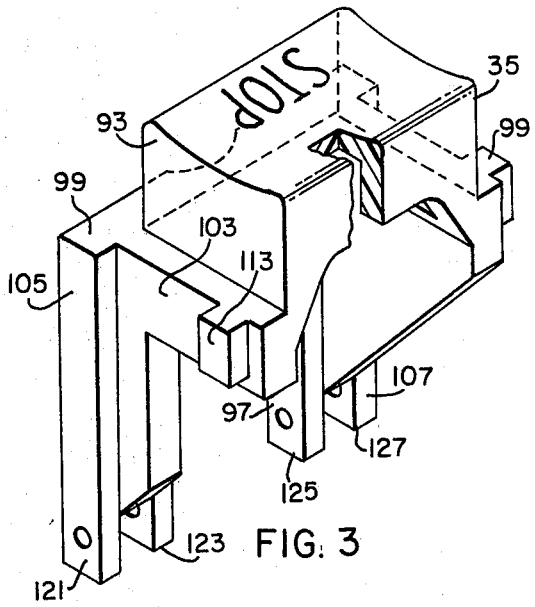
FIG. 3 is a perspective view of one of the pushbuttons.

Both pushbuttons 35 and 36 are similar construction and as shown in FIG. 3 the pushbutton 35 includes a head portion 93 and a pair of spaced downwardly extending portions 95 and 97, whereby each pushbutton 35, 36 is a generally U-shaped member. In addition, a shoulder extends around three sides of the head portion 93 which shoulder (FIG. 2) is normally seated against a surface 101 of the housing when the pushbutton 35 is fully extended as shown in FIG. 1. Thus the shoulder 99 and the surface 101 cooperate to prevent the pushbuttons from escaping from the housing 33. In addition, the pushbutton 35 comprises opposite side surfaces 103, one of which is shown in FIG. 3, which are in surface-to-surface contact with inner surfaces of the housing and thereby facilitate guiding of the pushbuttons 35 and 36 when they are depressed.

In addition to the foregoing, each pushbutton 35, 36 includes a vertical projection or tongue-like portion extending from the shoulder 99 to the lower end of the portion 95. A similar projection 107 is provided on the portion 97 of the pushbutton 35, 36. The projection 105 and 107 are disposed in projection-receiving grooves 109 and 111, respectively, which grooves are disposed in the inner wall of the housing 33. Moreover, each pushbutton 35, 36 is likewise preferably provided with a pair of projections 113, 115 which are seated in similar grooves 117 and 119 respectively. The combination of the projections 105, 107, 113, 115 and the surfaces 103 cooperate with the inner surfaces of the housing including the grooves 109, 111, 117, 119 to guide the movement of the pushbuttons 35, 36 when they are actuated. A minimum of binding between the pushbutton and the housing exists.

The lower ends of the depending portions 95, 97 are bifurcated to provide spaced members 121, 123, 125, and 127. As shown in FIG. 2, the depending portion 95 and 97 extend downwardly within the housing 33 with the bifurcated portions 121 and 123 seated over and around one projection 85 of the operating lever 97. The other bifurcated portions 125, 127 are seated around the projection 85 of the operating lever 79 on the other side of the housing. Accordingly, when the pushbutton 35, 36 is depressed, a force is applied against the projections 83 and 85 in order to tilt the operating lever 97 in one direction or the other thereby actuating the switch between the open and close positions.

In conclusion, the combination of the overload relay and the pushbutton switch provide protection against inadvertent operation of the switch as well as against overloads in the current. By providing the pushbuttons with molded projections which extend into grooves in opposite sides of the switch housing, each pushbutton is more easily depressed against the corresponding rocker arms whereby a vector force is applied to operate the rocker arms in a facilitated manner.

What is claimed is:

1. A circuit interrupting device comprising a switch mechanism, a frame, and an electrically insulating housing therefor, the switch mechanism comprising relatively movable contacts and operating means for moving the contacts between open and closed positions, the operating means comprising an overcenter toggle and a switch lever, the overcenter toggle including a toggle spring, a releasable arm operable to effect tripping of the movable contacts, one end of the switch lever being pivotally mounted on the frame and the toggle spring being secured to the other end, one end of the releasable arm being pivotally mounted on the frame and movable between tripped and latched positions, a latch lever releasably connected to the other end of the releasable arm for retaining said arm in the latched position, means responsive to a current overload condition for actuating the latch lever to the tripped position, an operating lever pivotally mounted on the frame and secured to the switch lever, said housing having an opening, a first pushbutton extending through the opening and engaging the operating lever to move the contacts to the open position, and a second pushbutton extending through the opening and engaging the operating lever to move the contacts to the closed position.

2. The circuit interrupter of claim 1 in which the housing comprises first surface means and the pushbutton comprise second surface means to guide the pushbuttons when they are actuated.

3. The circuit interrupter of claim 1 in which the first surface means comprises one member of a tongue and groove assembly and the second surface means comprises the other member of a tongue and groove assembly.

4. The circuit interrupter of claim 1 in which the second surface means comprise at least one tonguelike projection and the first surface means comprise at least one projection-receiving groove.

5. The circuit interrupting device of claim 1 in which the latch lever is actuated to the tripped position when the releasable means is operated.

6. A circuit interrupting device comprising a switch mechanism, a frame, and an electrically insulating housing therefor, the switch mechanism comprising relatively movable contacts and means releasable to effect automatic opening of said contacts, operating means for moving the contacts between open and closed positions and comprising overcenter toggle means and a releasable arm operable to effect tripping of the movable contacts, one end of the releasable arm being pivotally mounted on the frame, a latch lever releasably retaining the releasable arm in a latched position, a retaining lever for retaining the latch lever in latched position, a trip plate to effect movement of the retaining lever to an unlatched position of the latch lever, means responsive to a current overload condition and comprising a pivot trip lever for actuating the trip late to the tripped position, said housing having an opening, a first pushbutton extending through the opening and effective to move the contacts to the open position, and a second pushbutton extending through the opening and effective to move the contacts to the closed position.

7. The circuit interrupting device of claim 6 in which the releasable means comprises a releasable lever to automatically trip the overcenter toggle.

* * * * *